US006778201B2

(12) United States Patent
Rother

(10) Patent No.: US 6,778,201 B2
(45) Date of Patent: Aug. 17, 2004

(54) MONITORING CONSUMPTION OF PRINT RIBBON FOR PRINTERS

(75) Inventor: David J. Rother, Hastings, MN (US)

(73) Assignee: Rimage Corporation, Minneapolis, MN (US)

( * ) Notice: Subject to any disclaimer, the term of this patent is extended or adjusted under 35 U.S.C. 154(b) by 0 days.

(21) Appl. No.: 10/143,458

(22) Filed: May 9, 2002

(65) Prior Publication Data

US 2003/0210321 A1 Nov. 13, 2003

(51) Int. Cl.[7] ..... B41J 17/36; B41J 35/36
(52) U.S. Cl. ..... 347/217
(58) Field of Search ..... 347/217; 400/238, 400/703

(56) References Cited

U.S. PATENT DOCUMENTS 5,542,768 A 8/1996 Rother et al.
5,853,255 A * 12/1998 Soshi et al. ..... 400/237
5,957,594 A 9/1999 Loidl
6,302,601 B1 * 10/2001 Hagstrom et al. ..... 400/283
6,312,174 B1 11/2001 Drynkin et al.
6,321,649 B1 * 11/2001 Vangen et al. ..... 101/35
6,447,181 B1 * 9/2002 Hagstrom et al. ..... 400/120.01

FOREIGN PATENT DOCUMENTS

JP 10-297069 A * 11/1998 ..... B41J/35/36
WO WO-00/63020 * 10/2000 ..... B41J/3/407

* cited by examiner

*Primary Examiner*—Huan Tran
(74) *Attorney, Agent, or Firm*—Leffert Jay & Polglaze, P.A.

(57) ABSTRACT

A printer and method for monitoring consumption of a print ribbon of a thermal printer is provided. The method includes pressing the print ribbon against a medium located on a drawer of the thermal printer using a thermal print head of the thermal printer. The method includes moving the drawer and the print ribbon simultaneously and at substantially the same rate past the thermal print head so as to deposit a transferable coating of the print ribbon on the medium whereby printing an image on the medium. Measuring a distance moved by the drawer while pressing the print ribbon against the medium and equating the distance moved by the drawer to an amount of print ribbon consumed are also included in the method.

33 Claims, 4 Drawing Sheets

MONITORING CONSUMPTION OF PRINT RIBBON FOR PRINTERS

TECHNICAL FIELD

The present invention relates generally to the field of printers and, in particular, to printers with print ribbons.

BACKGROUND

Compact disc publishing and replicating systems often use a printer to place a label on the compact disc (CD). Several options are available for printing. One option is to print directly onto the disc using an ink jet printer or using a thermal transfer printer.

An important advantage that thermal transfer printers enjoy over inkjet printers used to label CDs is that they do not require specially coated CDs to accept the ink from the printing process. Although printable discs are available, they are more expensive than traditional un-coated media. Further, thermal transfer printers can print with greater speed and print on discs prepared with an inexpensive lacquer coating.

A thermal transfer printer typically includes a print head, a thermal transfer ribbon, and assembly to move the CD past the print head. The print head contains an array of thermal elements, and the thermal transfer ribbon is a plastic film with a transferable coating, such as a pigmented wax or resin compound, deposited on one side. The print head contacts the thermal transfer ribbon during printing, and the thermal transfer ribbon contacts the media. The transferable coating is deposited on the media by heating areas of the thermal transfer ribbon. Printing occurs by moving thermal transfer ribbon and the media at the same rate across the print head, while firing the heating elements in a desired pattern.

Multi-colored thermal transfer ribbon is used to print multi-colored images on a CD, and single-colored thermal transfer ribbon is used to print single-colored images on a CD. Multi-colored thermal transfer ribbon typically has a succession of tri-color panels, e.g., yellow, magenta, and cyan, and is usually consumed at a fixed rate because a different, previously unused tri-color panel is consumed for each print request. For example, if each print request corresponds to printing on a single CD, one tri-color panel is used for the CD.

In contrast, single-colored thermal transfer ribbon is usually consumed at a variable rate because only an approximate amount of thermal transfer ribbon that is required for a given print request is consumed. For example, a print request may involve printing a single line of text on a CD and thus approximately an amount of single-colored thermal transfer ribbon required to print the single line is used. Another print request may involve printing several lines of text on a CD, and in this case, approximately an amount of single-colored thermal transfer ribbon required to print several lines is used. The variable consumption rate of single-colored thermal transfer ribbon makes it difficult to monitor consumption of single-colored thermal transfer ribbon and thus to determine how much thermal transfer ribbon is available at any given time and how many print requests can be fulfilled with the available ribbon.

For the reasons stated above, and for other reasons stated below that will become apparent to those skilled in the art upon reading and understanding the present specification, there is a need in the art for monitoring consumption of ribbon of a printer.

SUMMARY

The above-mentioned problems with monitoring variable consumption of ribbon of printers and other problems are addressed by embodiments of the present invention and will be understood by reading and studying the following specification.

In one embodiment, a method for monitoring consumption of a print ribbon of a thermal printer is provided. The method includes pressing the print ribbon against a medium located on a drawer of the thermal printer using a thermal print head of the thermal printer. The method includes moving the drawer and the print ribbon simultaneously and at substantially the same rate past the thermal print head so as to deposit a transferable coating of the print ribbon on the medium, whereby printing an image on the medium. Measuring a distance moved by the drawer while pressing the print ribbon against the medium and equating the distance moved by the drawer to an amount of print ribbon consumed are also included in the method.

In another embodiment, a method for installing a ribbon within a printer is provided. The method includes disposing the ribbon within the printer so that a leader of the ribbon remains in an active sensing area. The method also includes detecting an indicator on the leader using a sensor, where detecting the indicator gives an amount of ribbon initially available for printing.

In another embodiment, a thermal printer is provided. The thermal printer includes a drawer to hold a medium for printing upon by the thermal printer. A thermal print head is included for pressing a print ribbon against the medium during printing. Moving the drawer and the print ribbon simultaneously and at substantially the same rate past the thermal print head while the thermal print head presses the print ribbon against the medium deposits a transferable coating of the print ribbon on the medium to print an image on the medium. A sensor is included for detecting an indicator on the print ribbon to give an amount of ribbon initially available for printing. Also included is a controller adapted to store an initial numerical quantity indicative of the amount of ribbon initially available for printing, to measure a distance moved by the drawer while the thermal print head presses the print ribbon against the medium, to subtract the distance from the initial numerical quantity indicative of the amount of ribbon initially available for printing to update the amount of the thermal transfer ribbon available for printing, and to store an updated numerical quantity indicative of the updated amount of the thermal transfer ribbon available for printing.

Additional embodiments are described and claimed.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Embodiments of the present invention provide for monitoring consumption of a thermal transfer ribbon of a thermal printer. A medium, such as a compact disc, to be printed on by the thermal printer is located on a movable drawer of the thermal printer. The medium is moved relative to a thermal print head of the thermal printer during printing. In particular, the thermal print head presses the thermal transfer ribbon against the medium, and the thermal transfer ribbon and the medium move simultaneously and at substantially the same rate relative to the thermal print head. As the thermal transfer ribbon and the media move, heating elements of the thermal print head are activated in a desired pattern to deposit a transferable coating of the thermal transfer ribbon on the medium to print an image on the medium.

During printing, the drawer and the thermal transfer ribbon move at substantially the same rate, so the distance moved by the drawer (while the head is active) is substantially equal to the distance moved by the thermal transfer ribbon. The distance moved by the thermal transfer ribbon is the amount of thermal transfer ribbon consumed during printing. Therefore, embodiments of the present invention determine the consumption of the thermal transfer ribbon from measurements of distances moved by the drawer during printing. This enables consumption of the thermal transfer ribbon to be determined for each print job irrespective of the size of the print job.

In some embodiments, the amount of thermal transfer ribbon initially available for printing, e.g., the amount available on a newly installed thermal transfer ribbon, is determined by detecting an indicator disposed on the thermal transfer ribbon during installation of the thermal transfer ribbon using a sensor disposed on the drawer. Subtracting the amount of thermal transfer ribbon consumed during printing from the amount initially available updates the amount of thermal transfer ribbon available and gives the availability of thermal transfer ribbon for subsequent print jobs.

Figure 1:
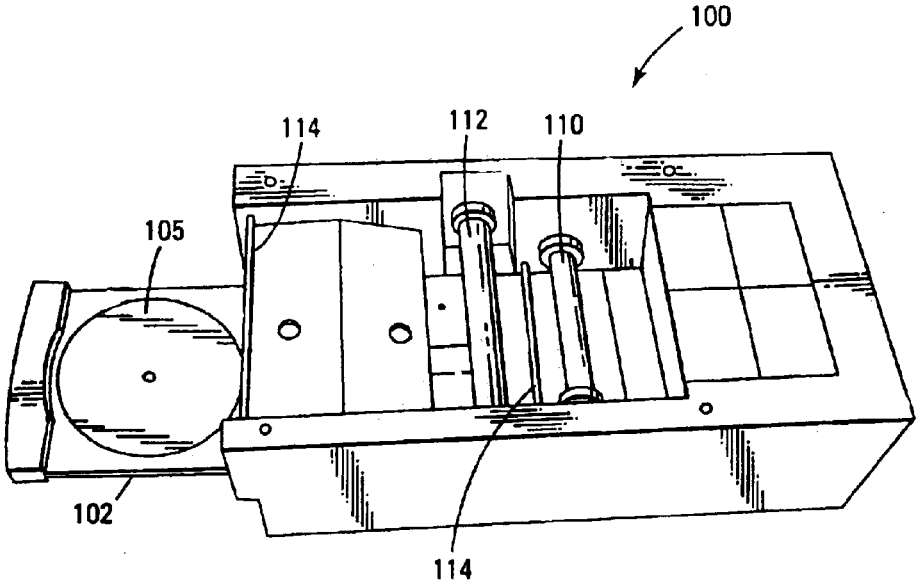
FIG. 1 is a top perspective view illustrating a thermal printer of one embodiment of the present invention.
Figure 2:
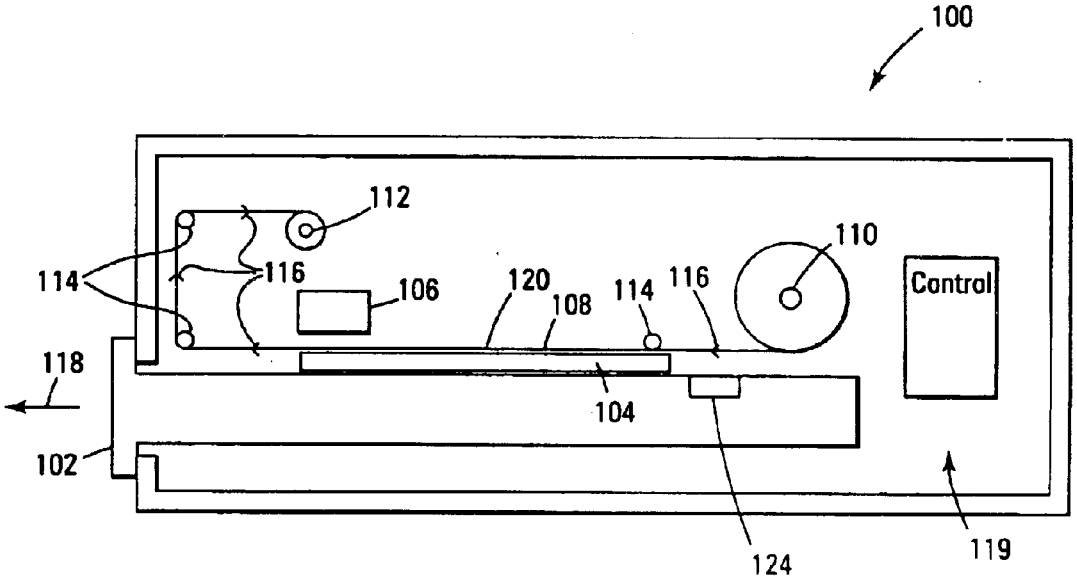
FIG. 2 is a cross-sectional view of the thermal printer of FIG. 1.

FIG. 1 is a top perspective view illustrating a thermal printer 100 of one embodiment of the present invention. FIG. 2 is a cross-sectional view of thermal printer 100. Thermal printer 100 includes a drawer 102 that holds a hard surface (or medium) 104, such as but not limited to a CD, a CD-R, a DVD-R, or other flat, receptive surface. In one embodiment, medium 104 is positioned on a pad 105 of drawer 102. Drawer 102 opens and closes to move medium 104 past a thermal print head 106. A thermal transfer ribbon 108, e.g., a single-color thermal transfer ribbon, is disposed around supply roller 110, take-up roller 112, and ribbon guides 114 and is located between thermal print head 106 and medium 104. In one embodiment, thermal printer 100 includes a controller 119 located generally as shown in FIG. 2 for controlling operation of thermal printer 100. In various embodiments, controller 119 includes software, firmware, and/or the like.

Controller 119 includes an algorithm for controlling operation of the thermal printer during printing. During printing, thermal print head 106 presses thermal transfer ribbon 108 against medium 104. Heating elements of an array of heating elements of thermal print head 106 heat areas of thermal transfer ribbon 108 and a transferable coating, such as a wax or resin compound, disposed on one side of thermal transfer ribbon 108 is deposited on medium 104. Printing occurs by moving thermal transfer ribbon 108 and media 104 simultaneously and at substantially the same rate across thermal print head 106 while activating the heating elements in a desired pattern. In one embodiment, moving drawer 102 in the direction of arrow 118 moves medium 104, which moves the thermal transfer ribbon 108 in the direction of arrowheads 116.

Figure 3:
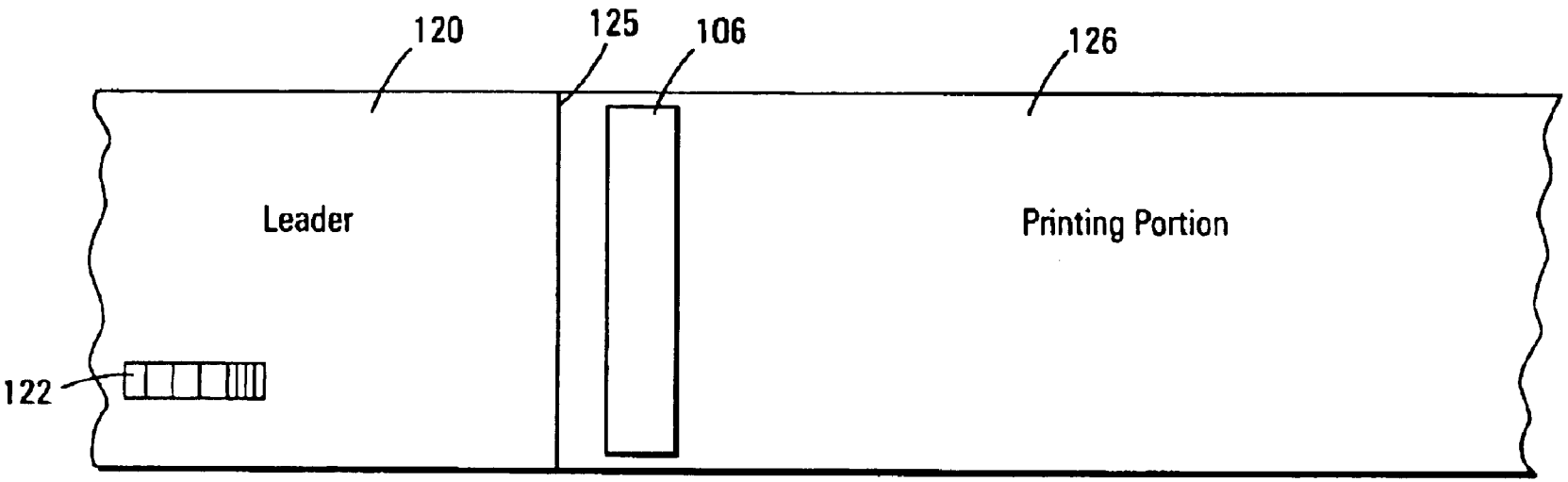
FIG. 3 is a top view of an embodiment of a thermal transfer ribbon and thermal print head of the thermal printer of FIG. 1.

To install thermal transfer ribbon 108 within thermal printer 100, thermal transfer ribbon 108 is disposed on supply roller 110. In one embodiment, a leader 120 of thermal transfer ribbon 108 is secured to drawer 102. Drawer 102 is opened to unwind leader 120 from supply roller 110 to position leader 120 so that leader 120 remains in an active sensing area, e.g., beneath thermal print head 106. Leader 120 is secured to take-up roller 112 so that leader 120 extends from supply roller 110 to take-up roller 112, as shown in FIG. 2. In one embodiment, leader 120 is a reflective material. In another embodiment, leader 120 includes an indicator 122, such as non-reflective bar code, logo, or the like, as shown in FIG. 3, a top view of thermal transfer ribbon 108 and thermal print head 106.

Drawer 102 is then moved from the open position to a sensing position, e.g., closed position. As drawer 102 moves to the closed position, a sensor 124 disposed on drawer 102 detects leader 120, indicating the presence of a new thermal transfer ribbon 108. When drawer 102 arrives at the sensing position, leader 120 starts to wind onto take-up roller 112 from supply roller 110. As leader 120 winds onto take-up roller 112, sensor 124 detects indicator 122. Upon detecting indicator 122, sensor 124 sends a signal to controller 119, and controller 119 instructs thermal printer 100 to stop winding leader 120 onto take-up roller 112 when an interface 125 separating leader 120 and a printing portion 126 of thermal transfer ribbon 108 containing the transferable coating moves past thermal print head 106, as shown in FIG. 3. Detection of indicator 122 by sensor 124 also causes controller 119 to store an initial numerical quantity indicative of an initial amount of printing portion 126 available for printing in a non-volatile memory of controller 119. In another embodiment, detection of indicator 122 is accomplished using an additional sensor located in a fixed position on the printer, for example, beneath thermal print head 106.

Monitoring distances moved by thermal transfer ribbon 108 accomplish monitoring consumption of printing portion 126 of thermal transfer ribbon 108. Subtracting these distances from the initial numerical quantity indicative of the amount of printing portion 126 initially available updates the amount of printing portion 126 available and gives an amount of printing portion 126 available for subsequent print jobs. Controller 119, in one embodiment, stores an updated numerical quantity indicative of the updated amount in its non-volatile memory.

In one embodiment, thermal transfer ribbon 108 moves only during printing while thermal print head 106 presses thermal transfer ribbon 108 against medium 104 and while drawer 102 moves medium 104 in the direction of arrow 118. In this embodiment, the distance moved by thermal transfer ribbon 108 while thermal print head 106 presses thermal transfer ribbon 108 against medium 104 is substantially equal to the distance moved by drawer 102. Therefore, in this embodiment, measurement of the distance moved by drawer 102 during printing gives the distance moved by thermal transfer ribbon 108, which is the amount of thermal transfer ribbon consumed during printing.

In some embodiments, a stepping motor moves drawer 102, where a number of rotations of the stepper motor is correlated to the distance moved by drawer 102 and thus thermal transfer ribbon 108. In these embodiments, controller 119 counts the number of rotations made by the stepper motor and subsequently computes the distance moved by drawer 102. In other embodiments, an encoder, e.g., connected to a slide or the like on drawer 102, measures the distance traveled by drawer 102 and conveys the distance to controller 119.

Prior to printing, in some embodiments, drawer 102 moves to position medium 104 for printing. After medium 104 is positioned, thermal print head 106 presses thermal transfer ribbon 108 against medium 104, and thermal transfer ribbon 108 and medium 104 start to move past thermal print head 106 commencing printing. In one embodiment, a signal is received by controller 119 when thermal print head 106 presses thermal transfer ribbon 108 against medium 104 instructing controller 119 to start measuring the distance moved by drawer 102 when thermal transfer ribbon 108 and medium 104 start to move past thermal print head 106, e.g., by counting the number of rotations of the stepper motor. In another embodiment, after printing, that is, when thermal print head 106 is moved out of engagement with medium 104 and thermal transfer ribbon 108 stops moving, drawer 102 continues to move to a fully open position so that the printed medium can be removed from thermal printer 100 or to another requested position as determined by controller 119. In another embodiment, when thermal transfer ribbon 108 is moved out of engagement with medium 104, a signal is sent to controller 119 to stop the measurement of the distance moved by drawer 102. The signals sent to start and stop the measurement ensure that the measured distance moved by drawer 102 corresponds to the distance moved by drawer 102 during printing and is thus the amount of thermal transfer ribbon 108 consumed during printing.

In other embodiments, controller 119 determines how much of thermal transfer ribbon 108 will be consumed for a given print job, e.g., based on the size of an image and the number of images in the print job. The controller then determines if there is enough of thermal transfer ribbon 108 available to complete the job by comparing the amount of thermal transfer ribbon 108 that will be consumed to the available amount of thermal transfer ribbon 108, e.g., determined from the measurements described above. In one embodiment, controller 119 computes the percentage of the print job that can be completed with the available amount of thermal transfer ribbon 108.

Figure 4:
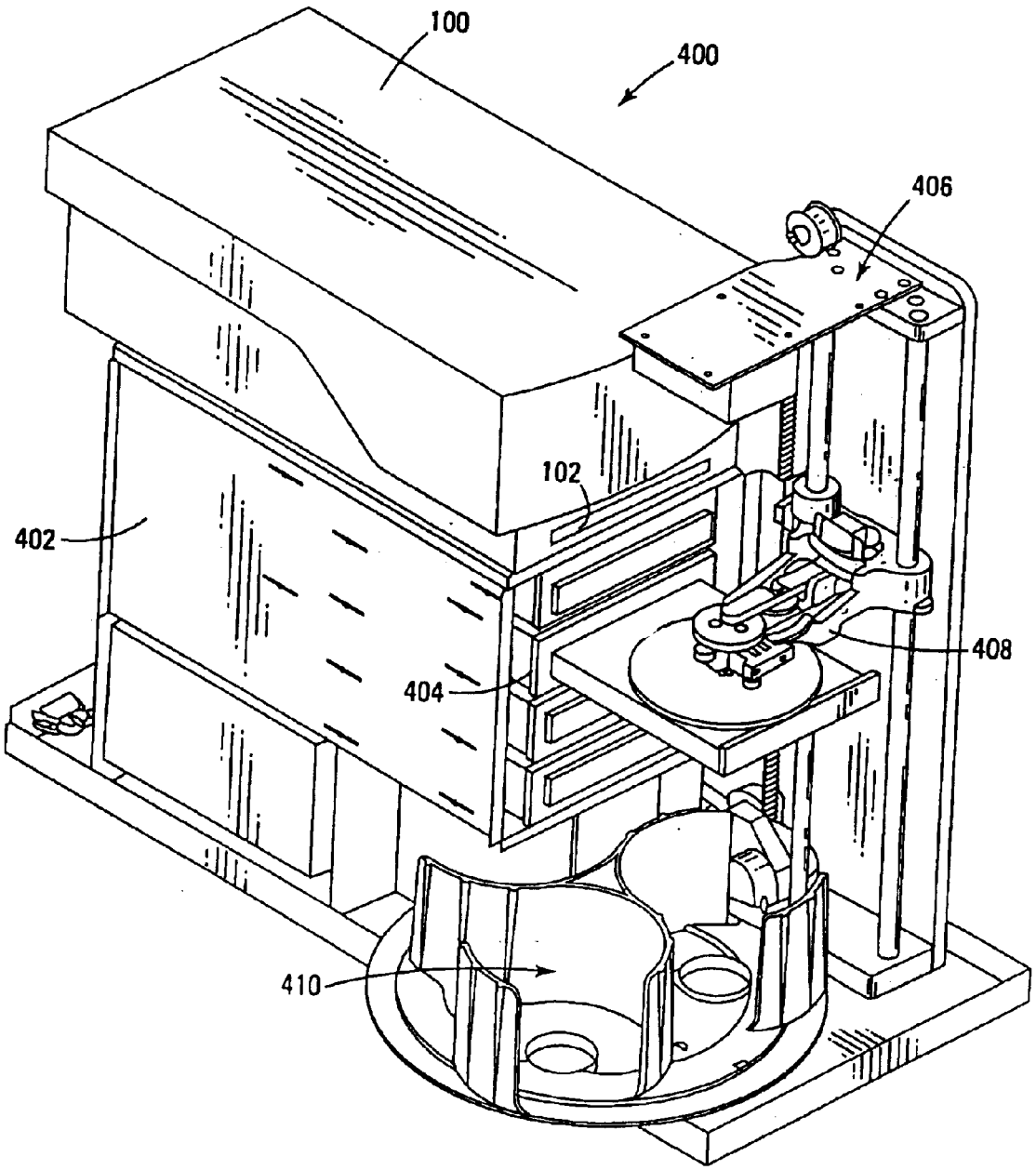
FIG. 4 is a thermal transfer printer system of another embodiment of the present invention.

In various embodiments, thermal printer 100 is incorporated into an automatic thermal transfer printer system 400, as shown in FIG. 4. The system includes a base 402 that can house disc recorders 404 or other processing options (not illustrated in detail). A transport mechanism 406 and disc gripper head 408 are used to load and unload discs from the printer drawer 102. Transport mechanism 406 also moves the discs to other locations, such as bin 410. The present invention is not limited to the illustrated automatic transporter system. Design changes can be incorporated to alter disc gripper head 408, replace bin 410 with a spindle, or alter the range of movement of transport mechanism 406 without departing from the present invention. For alternate embodiments of transport mechanisms see U.S. Pat. Nos. 5,914,918 and 6,321,649.

CONCLUSION

Embodiments of the present invention have been described. The embodiments provide for determining consumption of the thermal transfer ribbon of a thermal printer from measurements of distances moved by a drawer of the thermal printer during printing. A medium, such as a compact disc, to be printed on by the thermal printer is located on the drawer of the thermal printer. The medium is moved relative to a thermal print head of the thermal printer during printing. The thermal print head presses the thermal transfer ribbon against the medium. The drawer and the thermal transfer ribbon move simultaneously and at substantially the same rate relative to the thermal print head so as to deposit a transferable coating of the thermal transfer ribbon on the medium, thereby printing an image on the medium. Therefore, the distance moved by the drawer during printing is substantially equal to the distance moved by the thermal transfer ribbon, which is the amount of thermal transfer ribbon consumed. This enables consumption of the thermal transfer ribbon to be determined for each print job irrespective of the size of the print job.

In some embodiments, the amount of thermal transfer ribbon initially available for printing, e.g., the amount available on a newly installed thermal transfer ribbon, is determined by detecting an indicator disposed on the thermal transfer ribbon during installation of the thermal transfer ribbon using a sensor disposed on the drawer. Subtracting the amount of thermal transfer ribbon consumed during printing from the amount initially available updates the amount of thermal transfer ribbon available and gives the availability of thermal transfer ribbon for subsequent print jobs.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. It is manifestly intended that this invention be limited only by the following claims and equivalents thereof.

What is claimed is:

1. A method for installing a ribbon within a printer, the method comprising:

disposing the ribbon within the printer so that a leader of the ribbon remains in an active sensing area; and detecting an indicator on the leader indicative of an amount of ribbon initially available for printing using a sensor disposed on a movable drawer of the printer adapted to hold a medium for printing upon by the printer.

2. A method for installing a ribbon within a printer, the method comprising:

disposing the ribbon within the printer so that a leader of the ribbon remains in an active sensing area;

detecting an indicator on the leader using a sensor, wherein the indicator is indicative of an amount of ribbon initially available for printing; and moving a drawer of the printer relative to the leader from an initial to a sensing position, wherein the drawer is adapted to hold a medium for printing upon by the printer; and detecting the presence of the leader using a sensor disposed on the drawer as the drawer moves from the initial to the sensing position.

3. The method of claim 1, wherein detecting an indicator on the leader comprises detecting a non-reflective indicator on the leader.

4. The method of claim 2, further comprising winding the leader onto one roll of the printer from another roll of the printer when the drawer arrives at the sensing position.

5. The method of claim 4, wherein detecting the indicator further comprises instructing the winding of the leader to stop when an interface of the thermal transfer ribbon separating the leader from a printing portion of the thermal transfer ribbon moves past a thermal print head of the thermal printer.

6. The method of claim 1, wherein disposing the thermal transfer ribbon within the thermal printer comprises disposing a single-color thermal transfer ribbon within the thermal printer.

7. The method of claim 2, wherein detecting the presence of the leader comprises detecting the presence of a reflective leader.

8. A method for monitoring consumption of a print ribbon of a thermal printer, the method comprising:

pressing the print ribbon against a medium located on a drawer of the thermal printer using a thermal print head of the thermal printer;

moving the drawer and the print ribbon simultaneously and at substantially the same rate past the thermal print head so as to deposit a transferable coating of the print ribbon on the medium, whereby printing an image on the medium;

measuring a distance moved by the drawer while pressing the print ribbon against the medium; and equating the distance moved by the drawer to an amount of print ribbon consumed.

9. The method of claim 8, wherein moving the drawer is accomplished using a stepper motor.

10. The method of claim 8, wherein measuring the distance moved by the drawer comprises counting a number of rotations of a stepper motor adapted to move the drawer, wherein the number of rotations is correlated to the distance moved by the drawer.

11. The method of claim 8, wherein pressing the print ribbon against a medium comprises pressing a single-color print ribbon against the medium.

12. The method of claim 8, wherein pressing the print ribbon against a medium comprises pressing the print ribbon against a surface.

13. The method of claim 8, wherein pressing the print ribbon against a medium comprises pressing the print ribbon against a compact disc.

14. The method of claim 8, further comprising positioning the medium relative to the thermal print head by moving the drawer before pressing the print ribbon against the medium.

15. The method of claim 8, wherein measuring the distance moved by the drawer comprises using a controller of the thermal printer.

16. The method of claim 8, further comprising receiving a signal at a controller of the thermal printer upon pressing the print ribbon against the medium instructing the controller to measure the distance moved by the drawer.

17. The method of claim 8, further comprising moving the thermal print head out of engagement with the medium and the print ribbon, wherein the print ribbon stops moving while the drawer continues to move.

18. The method of claim 17, further comprising receiving a signal at a controller of the thermal printer upon moving the thermal print head out of engagement with the medium and the print ribbon instructing the controller to stop measuring the distance moved by the drawer.

19. The method of claim 17, further comprising stopping measuring the distance moved by the drawer upon moving the thermal print head out of engagement with the medium and the print ribbon.

20. The method of claim 8, further comprising initiating measuring the distance moved by the drawer upon pressing the print ribbon against the medium.

21. A method for monitoring an amount of a thermal transfer ribbon of a thermal printer available for printing, the method comprising:

determining an initial amount of the thermal transfer ribbon available for printing by detecting an indicator on the thermal transfer ribbon;

pressing the thermal transfer ribbon against a medium positioned on the drawer using a thermal print head of the thermal printer;

moving the drawer and the thermal transfer ribbon simultaneously and at substantially the same rate past the thermal print head so as to deposit a transferable coating of the thermal transfer ribbon on the medium, whereby printing an image on the medium;

measuring a distance moved by the drawer while pressing the thermal transfer ribbon against the medium;

equating the distance moved by the drawer to an amount of thermal transfer ribbon consumed; and updating the amount of the thermal transfer ribbon available for printing by subtracting the amount of thermal transfer ribbon consumed from the initial amount of thermal transfer ribbon available for printing.

22. The method of claim 21, wherein detecting an indicator on the thermal transfer ribbon comprises at least one of detecting the indicator on a leader of the thermal transfer ribbon, detecting the indicator on a reflective leader of the thermal transfer ribbon, and detecting a non-reflective indicator.

23. The method of claim 21, wherein pressing the thermal transfer ribbon against a medium comprises pressing the thermal transfer ribbon against a compact disc.

24. The method of claim 21, further comprising positioning the medium relative to the thermal print head by moving the drawer before pressing the thermal transfer ribbon against the medium.

25. The method of claim 21, further comprising initiating measuring the distance moved by the drawer upon pressing the thermal transfer ribbon against the medium.

26. The method of claim 21, further comprising moving the thermal print head out of engagement with the medium and the thermal transfer ribbon, wherein the thermal transfer ribbon stops moving while the drawer continues to move.

27. The method of claim 26, further comprising stopping measuring the distance moved by the drawer upon moving the thermal print head out of engagement with medium and thermal transfer ribbon.

28. A thermal printer comprising:

a receptacle to hold a medium for printing upon by the thermal printer;

a thermal print head for pressing a print ribbon against the medium during printing, wherein moving the receptacle and the print ribbon simultaneously and at substantially the same rate past the thermal print head while the thermal print head presses the print ribbon against the medium deposits a transferable coating of the print ribbon on the medium to print an image on the medium;

a sensor for detecting an indicator on the print ribbon indicative of an amount of ribbon initially available for printing; and a controller adapted to store an initial numerical quantity indicative of the amount of ribbon initially available for printing, to measure a distance moved by the receptacle while the thermal print head presses the print ribbon against the medium, to subtract the distance from the initial numerical quantity indicative of the amount of ribbon initially available for printing to update the amount of the thermal transfer ribbon available for printing, and to store an updated numerical quantity indicative of the updated amount of the thermal transfer ribbon available for printing.

29. The thermal printer of claim 28, further comprising a stepper motor adapted to move the receptacle.

30. The thermal printer of claim 28, wherein the controller counts a number of rotations of a stepper motor adapted to move the receptacle to measure the distance moved by the drawer.

31. A thermal transfer printer, comprising:

a drawer to hold a compact disc for printing upon by the thermal printer;

a thermal print head for pressing a print ribbon against the compact disc during printing, wherein moving the drawer and the print ribbon simultaneously and at substantially the same rate past the thermal print head while the thermal print head presses the print ribbon against the compact deposits a transferable coating of the print ribbon on the compact disc to print an image on the compact disc;

a sensor for detecting an indicator on the print ribbon to give an amount of ribbon initially available for printing; and a controller adapted to store an initial numerical quantity indicative of the amount of ribbon initially available for printing, to measure a distance moved by the drawer while the thermal print head presses the print ribbon against the medium, to subtract the distance from the initial numerical quantity indicative of the amount of ribbon initially available for printing to update the amount of the thermal transfer ribbon available for printing, and to store an updated numerical quantity indicative of the updated amount of the thermal transfer ribbon available for printing.

32. The thermal transfer printer of claim 31, wherein the sensor is disposed on the drawer.

33. A thermal transfer printer system comprising:

a transporter having a robotic assembly to physically move a medium for printing upon by the thermal transfer printer system; and a thermal transfer printer comprising:

a drawer to hold the medium, a thermal print head for pressing a print ribbon against the medium during printing, wherein moving the drawer and the print ribbon simultaneously and at substantially the same rate past the thermal print head while the thermal print head presses the print ribbon against the medium deposits a transferable coating of the print ribbon on the medium to print an image on the medium, a sensor disposed on the drawer for detecting an indicator on the print ribbon to give an amount of ribbon initially available for printing, and a controller adapted to store an initial numerical quantity indicative of the amount of ribbon initially available for printing, to measure a distance moved by the drawer while the thermal print head presses the print ribbon against the medium, to subtract the distance from the initial numerical quantity indicative of the amount of ribbon initially available for printing to update the amount of the thermal transfer ribbon available for printing, and to store an updated numerical quantity indicative of the updated amount of the thermal transfer ribbon available for printing.

* * * * *